US009556627B2

(12) United States Patent
Weaver

(10) Patent No.: US 9,556,627 B2
(45) Date of Patent: Jan. 31, 2017

(54) CONCRETE PIER FOUNDATION ANCHOR BOLT SUPPORT AND CHAMFER FORM

(71) Applicant: Everett David Weaver, Tulsa, OK (US)

(72) Inventor: Everett David Weaver, Tulsa, OK (US)

( * ) Notice: Subject to any disclaimer, the term of this patent is extended or adjusted under 35 U.S.C. 154(b) by 196 days.

(21) Appl. No.: 14/197,496

(22) Filed: Mar. 5, 2014

(65) Prior Publication Data

US 2014/0252199 A1 Sep. 11, 2014

Related U.S. Application Data

(60) Provisional application No. 61/773,086, filed on Mar. 5, 2013.

(51) Int. Cl.
*E04G 13/02* (2006.01)
*E04G 21/18* (2006.01)
*E04G 17/00* (2006.01)

(52) U.S. Cl.
CPC ..... *E04G 13/021* (2013.01); *E04G 17/004* (2013.01); *E04G 21/185* (2013.01)

(58) Field of Classification Search
CPC .... E04G 13/021; E04G 21/185; E04G 17/004; E02D 5/38
USPC ..... 249/48, 49, 51, 98, 139, 143, 173, 219.1
See application file for complete search history.

(56) References Cited

U.S. PATENT DOCUMENTS 881,183 A * 3/1908 Guyer ..... E04G 13/02 249/146
1,114,946 A * 10/1914 Venable ..... E04G 13/021 249/156
1,597,164 A * 8/1926 MacKenzie ..... B28B 7/0014 249/140
1,600,433 A * 9/1926 Stieler ..... E04G 21/12 249/17
1,951,949 A * 3/1934 Provance ..... E21D 15/48 249/155
2,677,165 A * 5/1954 Copenhaver ..... E04G 13/021 138/144
3,025,608 A * 3/1962 Hendrix ..... B25D 5/02 242/388
3,144,699 A * 8/1964 Williams ..... B28B 7/0014 249/164
3,159,898 A * 12/1964 Van Name ..... E02D 5/28 249/1
3,204,493 A * 9/1965 Severdia ..... B23B 47/28 33/645
3,219,308 A * 11/1965 Halstead ..... E02D 27/00 249/205
3,588,027 A * 6/1971 Bowden ..... E04G 13/021 220/4.28

(Continued)

*Primary Examiner* — Yogendra Gupta
*Assistant Examiner* — Emmanuel S Luk
(74) *Attorney, Agent, or Firm* — Martin S. High, P.C.

(57) ABSTRACT

Embodiments of the Concrete Form include a form tube, chamfer disk, and one or more form cross-members. The form cross-members are comprised of a center pivot, two bolt guides, which are formed by the cross-members, and an optional clamp. The chamfer disk is a disk that sits atop of the form tube and forms side chamfers when placed upon the form tube when the concrete cures. The chamfer disk is a separate formed or molded piece that will sit on top of the tube form in order to form a chamfer in the concrete. The chanfer disk is a ring-shaped device with the chamfer formed in positive relief under the ring of the chamfer disk. The optional clamp can be used to hold any conduit, tube or any other item during the pour.

1 Claim, 7 Drawing Sheets

(56) References Cited

U.S. PATENT DOCUMENTS 3,759,478 A * 9/1973 Schmitt ..... C11C 5/021 249/102
3,799,492 A * 3/1974 O'Laughlin ..... C11C 5/023 249/139
4,790,509 A * 12/1988 Cardwell ..... E04G 17/14 248/59
4,972,641 A * 11/1990 Barrios ..... E02D 5/38 249/48
5,048,781 A * 9/1991 Breen ..... E04G 17/12 249/219.1
5,255,888 A * 10/1993 Workman ..... E04G 13/021 249/165
5,630,303 A * 5/1997 Devenish, III ..... E02D 27/32 248/346.01
5,740,645 A * 4/1998 Raby ..... E02D 27/42 248/346.5
5,782,050 A * 7/1998 Boeshart ..... E04B 2/8652 249/213
6,220,784 B1 * 4/2001 Bricker ..... E03F 3/046 249/10
6,893,598 B1 * 5/2005 March ..... E02D 9/005 264/267
7,556,752 B1 * 7/2009 Hicks ..... E04G 13/021 249/165
7,721,494 B2 * 5/2010 Lee ..... E02D 27/00 24/21
7,984,541 B1 * 7/2011 Davidson ..... B25B 23/00 249/51
D702,569 S * 4/2014 Moore ..... D10/64
9,255,409 B2 * 2/2016 Moore ..... E04C 5/168
2012/0018942 A1 * 1/2012 Penza ..... E04G 13/021 269/287
2012/0324825 A1 * 12/2012 Vrame ..... E04B 1/38 52/745.21
2013/0067849 A1 * 3/2013 Espinosa ..... E04B 1/4121 52/699
2015/0113886 A1 * 4/2015 Chang ..... E04G 21/185 52/105

* cited by examiner

CONCRETE PIER FOUNDATION ANCHOR BOLT SUPPORT AND CHAMFER FORM

CROSS-REFERENCE TO RELATED APPLICATIONS

This application claims benefit of U.S. Provisional Application No. 61/773,086, filed on Mar. 5, 2013. U.S. Provisional Patent Application No. 61/773,086 is incorporated by reference in its entirety for all purposes as if fully set forth herein.

STATEMENT REGARDING FEDERALLY SPONSORED RESEARCH OR DEVELOPMENT

Not applicable

FIELD OF THE EMBODIMENTS

The field of the embodiments of the Concrete Form is concrete forms used to contain concrete during the curing process of the concrete.

BACKGROUND OF THE EMBODIMENTS

The background of the embodiments of the Concrete Form is the broad use of concrete forms. When forming a support pylon for objects including lamp posts, signs, and structural piers, it is common to use concrete form tubes to contain the concrete while it is curing. Usually the form is a simple, water-resistant tube that the concrete is poured into and allowed to contain the concrete during cure. This simple form does not permit finer finishing of the concrete including the formation of a chamfer on the outer edges of the concrete.

SUMMARY OF THE EMBODIMENTS

In summary, the embodiments of the Concrete Form are comprised of a form tube, one or more form cross-members, a chamfer disk, and one or more optional clamps. The form cross-members are comprised of a center pivot, one or more bolt guides, which are formed by the cross-members. The chamfer in the concrete is formed by the chamfer disk which is placed on top of the concrete form tube. The chamfer disk is a separate formed/molded piece that will sit ontop of the tube form in order to form a chamfer in the concrete. The optional clamp can be used to hold any conduit, tube or any other item during the pour. The anchor bolt holder will have two cross members with two bolt guides per arm. This will give a total of four locations that an anchor bolt can be installed. The form cross-members are manufactured from steel or alternatively of a polymeric material and are approximately ¼ inch in thickness and approximately 2 inches wide. The form cross-members will be thicker towards the end of the cross-members (the ends that rest on the circumference of the form) relative to the middle of the cross-members to provide the necessary support for the Concrete Form when in practice.

In this respect, it is to be understood that the embodiments in this application are not limited to the details of construction and to the arrangements of the components set forth in the description or illustrated in the drawings. The embodiments are capable of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the embodiments described in this application. Additional benefits and advantages of the present embodiments will become apparent in those skilled in the art to which the embodiments relate from the description of the preferred embodiment and the appended claims, taken in conjunction with the accompanying drawings. It is important, therefore, that the claims be regarded as including such equivalent constructions insofar as they do not depart from the spirit and scope of the embodiments described herein.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the embodiments of the application, which is measured by the claims, nor is it intended to be limiting as to the scope of the embodiments in any way.

DETAILED DESCRIPTION OF THE PREFERRED EMBODIMENTS

Figure 1:
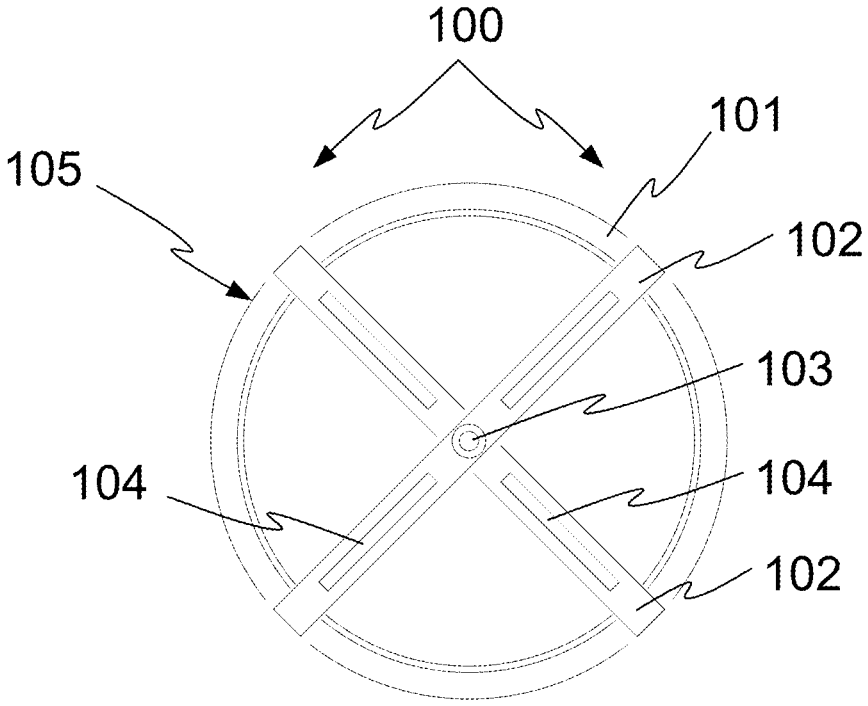
FIG. 1 is a top view of an embodiment of the Concrete Form.
Figure 2:
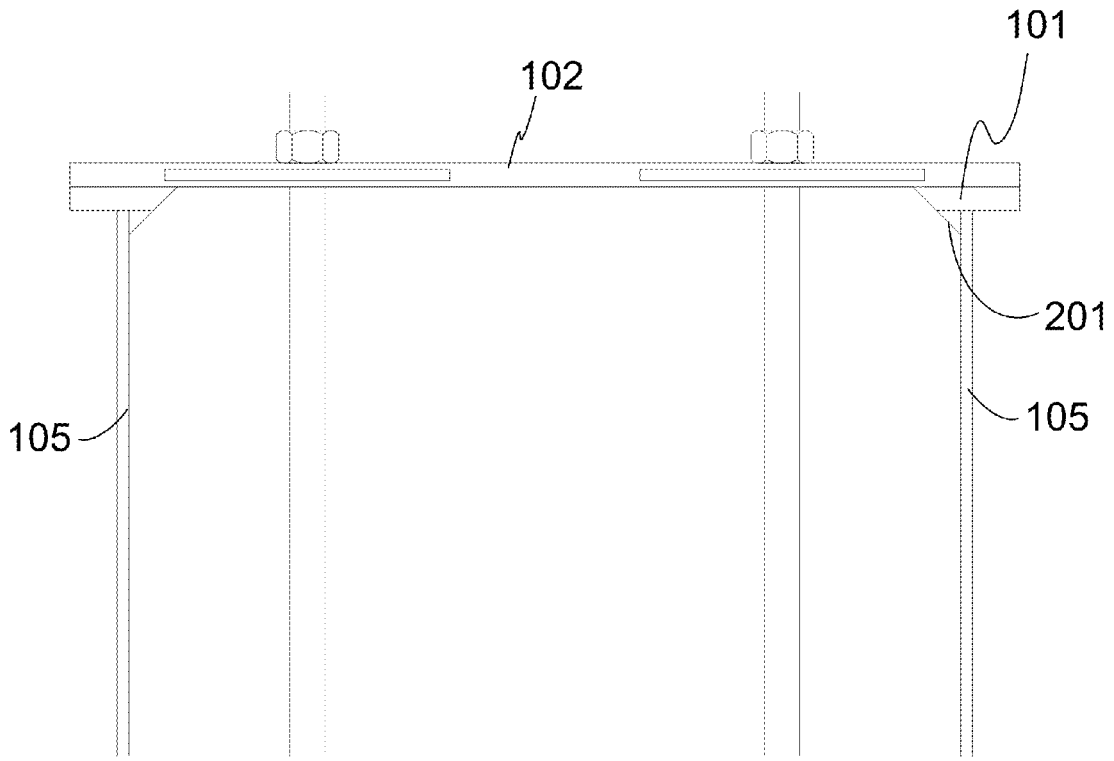
FIG. 2 is a side of an embodiment of the Concrete Form.
Figure 3:
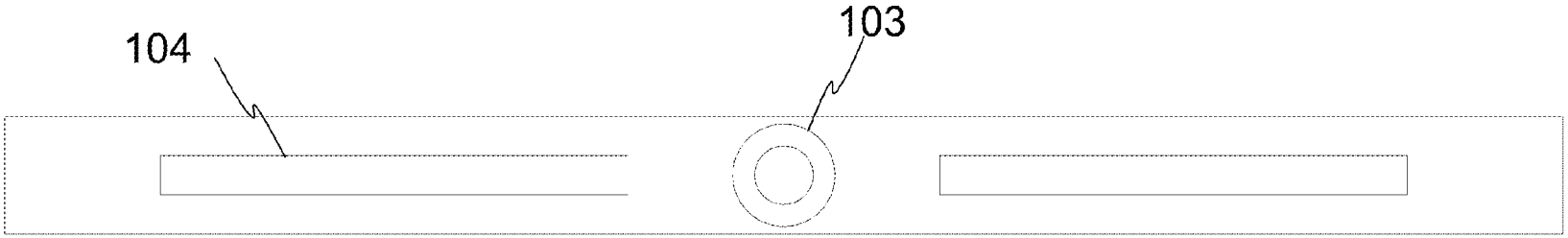
FIG. 3 is a top view of an embodiment of the cross bar of the Concrete Form.
Figure 4:
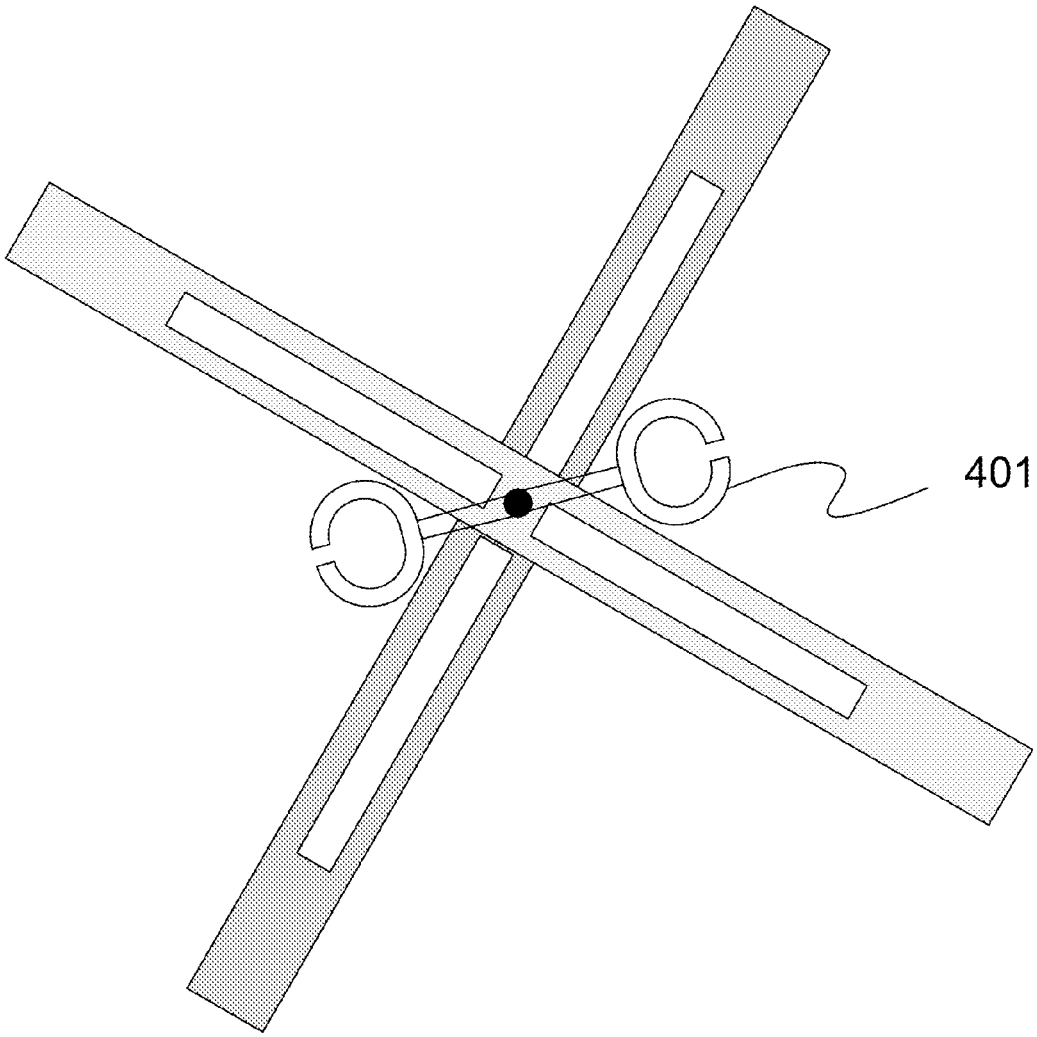
FIG. 4 is a top view of an embodiment of the the Concrete form with an embodiment of the conduit support attached to the crossbar.
Figure 5:
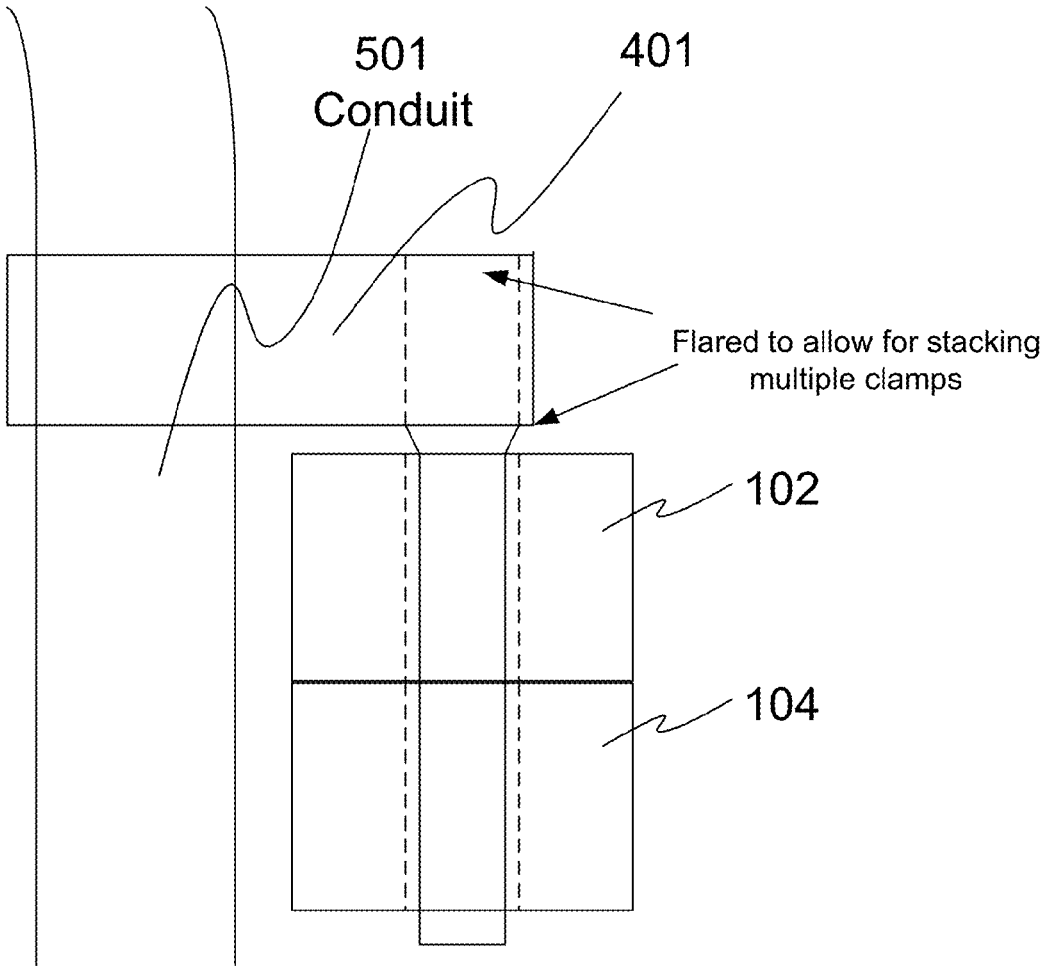
FIG. 5 is a schematic view of an embodiment of the Concrete Form showing how the stacking pivot points are used to secure the clamps that in turn secures a conduit.

Embodiments of the Concrete Form 100 include a form tube 105, chamfer disk 101 and one or more form cross-members 102.

The form cross-members 102 are comprised of a center pivot 103, two bolt guides 104, which are formed by the cross-members 102, and an optional clamp 401. The chamfer disk 101 is a disk that sits atop of the form tube 105. The chamfer disk 101 forms side chamfers 201 that when placed upon the form tube 105, causes chamfers to be formed in the concrete when it is poured. The form cross-members 102 are manufactured from steel and are approximately ¼ inch in thickness and approximately two (2) inches wide. The form cross-members 102 will be thicker towards the end of the cross-members 102 (the ends that rest on the circumference of the form) relative to the middle of the cross-members 102 to provide the necessary support for the Conrete Form 100 when in practice.

The chamfer disk 101 is placed on top of the form tube 105 when in use. The chamfer in the concrete is formed by the chamfer disk 101 which is placed on top of the concrete form tube. The chamfer disk 101 is a separate formed or molded piece that will sit on top of the tube form in order to form a chamfer in the concrete. The chanfer disk 101 is a ring-shaped device with the chamfer formed in positive relief under the ring of the chamfer disk 101.

The optional clamp 401 can be used to hold any conduit, tube or any other item during the pour. The bolt guides 104 will have two cross members with two bolt slots/guides per arm. This will give a total of four locations that an anchor bolt can be installed.

Figure 6B:
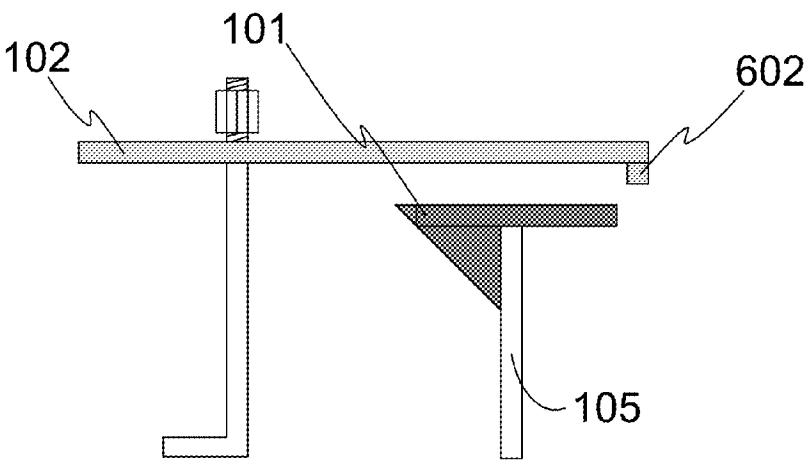
FIG. 6B is a schematic view of an embodiment of the Concrete Form showing how the end of the cross-member distal from the clamps forms a cross-member edge to secure the cross-member to the form tube.
Figure 6A:
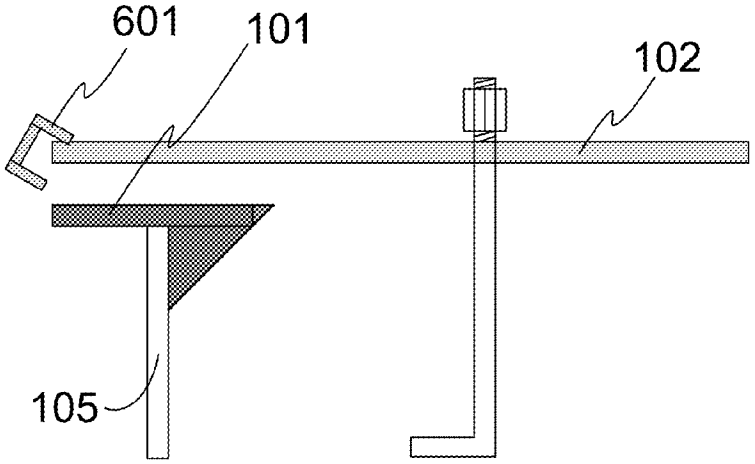
FIG. 6A is a schematic view of an embodiment of the Concrete Form showing how the end clamps are installed to secure a cross-member to the chamfer disc.
Figure 7B:
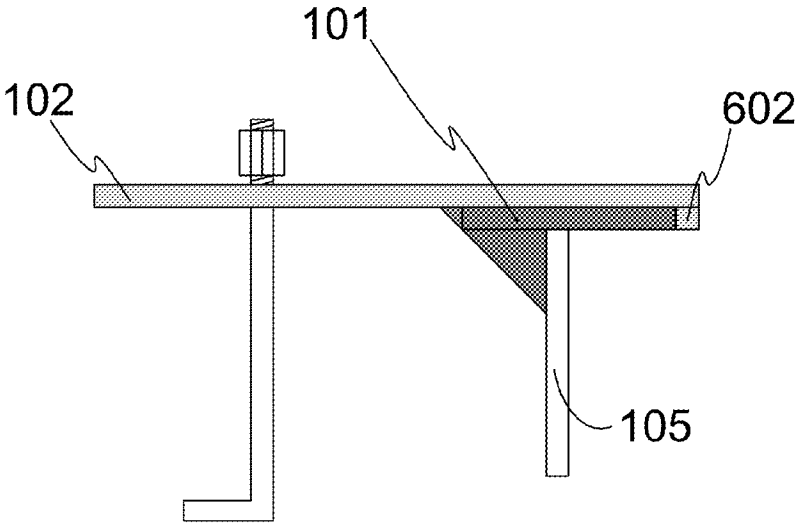
FIG. 7B is a schematic view of an embodiment of the Concrete Form showing the cross-member edge engaged to secure the cross-member to the form tube.
Figure 7A:
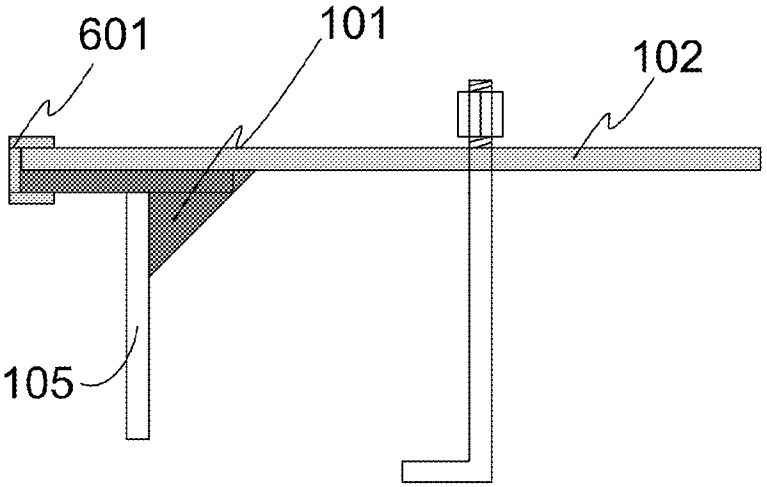
FIG. 7A is a schematic view of an embodiment of the Concrete Form showing the end clamps engaged to secure a cross-member to the chamfer disc.

The form cross-members 102 are comprised of a cross-member edge 602. The cross-member edge serves as a support for the cross-member when placed on top of the form tube 105. The cross-member edge 602 is used in conjunction with the cross-member clamp 601 , the chamfer disk 101, and a cross-member 102 to secure the cross-member to the form tube. The chamfer disk 101 is first placed atop of the form tube 105. Then the cross-member is engaged to the chamfer disk with the cross-member edge (see FIG. 6B). Lastly the cross-member is affixed to the chamfer disk 101 with the cross-member clamp 601 (see FIG. 6A).

The form cross-members 102 form one or more bolt guides 104 that serves to maintain the position of anchor bolts as the concrete is cured. The anchor bolts 104 are set and then the concrete is poured into the form. Once the concrete cures, the Concrete Form 100 is removed leaving the bolts positioned correctly for the installation of the object to be mounted.

The chamfer disk 101 allow the user to produce uniform chamfers on the side of the concrete. The user pours the concrete into the form 101 and fills the form 101. Once the concrete hardens sufficiently, the user can remove the chamfer disk exposing the formed chamfer on the concrete.

The clamp 401 is an optional device that can be installed over the center pivot 103 with a fastener. The clamp 401 can be used to position and secure conduits, rebar, bolts, or any other object that needs to be placed in the hardening concrete. The user secures the object to be positioned with the clamp 401 and allows the concrete to harden thereby affixing the object in the concrete.

An overlay template can also be affixed to the center pivot 103. The template can then be used to position conduits, rebar, bolts, or any other object that needs to be placed in the hardening concrete at a specific location. By way of an example, a bolt that is used to secure a light fixture or pole must be placed over bolts embedded in the concrete.

I claim:

1. A concrete form comprised of a. a form tube;

b. a chamfer disk which sits upon the form tube;

c. one or more form cross-members which provide the necessary support for the concrete form;

d. wherein the form cross-members are comprised of i. a center pivot which connects the cross-members, ii. two bolt guides which are formed by the cross-members, and iii. an optional clamp used to hold any conduit, tube or any other item during the pour;

e. wherein the chamfer disk is a disk that sits atop of the form tube where the chamfer disk forms side chamfers that when placed upon the form tube causes chamfers to be formed in the concrete when it is poured;

f. wherein the form cross-members are comprised of a cross-member edge i. wherein the cross-member edge serves as a support for the cross-member when placed on top of the form tube; and ii. wherein the cross-member edge is used in conjunction with the cross-member clamp, the chamfer disk, and a cross-member to secure the cross-member to the form tube.

* * * * *